US011834791B2

(12) United States Patent
Watanabe et al.

(10) Patent No.: US 11,834,791 B2
(45) Date of Patent: Dec. 5, 2023

(54) METHOD FOR MANUFACTURING PAPER BARRIER BASE MATERIAL

(71) Applicants: NIPPON PAPER INDUSTRIES CO., LTD., Tokyo (JP); JUJO THERMAL OY, Kauttua (FI)

(72) Inventors: Kenta Watanabe, Tokyo (JP); Yuri Oishi, Tokyo (JP); Satoshi Tsuda, Tokyo (JP); Masashi Okamoto, Kauttua (FI); Hiroshi Koyamoto, Tokyo (JP)

(73) Assignees: NIPPON PAPER INDUSTRIES CO., LTD., Tokyo (JP); JUJO THERMAL OY, Kauttua (FI)

( * ) Notice: Subject to any disclaimer, the term of this patent is extended or adjusted under 35 U.S.C. 154(b) by 167 days.

(21) Appl. No.: 17/598,598

(22) PCT Filed: Mar. 26, 2020

(86) PCT No.: PCT/JP2020/013558

§ 371 (c)(1),
(2) Date: Sep. 27, 2021

(87) PCT Pub. No.: WO2020/203616

PCT Pub. Date: Oct. 8, 2020

(65) Prior Publication Data

US 2022/0154403 A1 May 19, 2022

(30) Foreign Application Priority Data

Mar. 29, 2019 (JP) ..... 2019-067072

(51) Int. Cl.
*D21H 19/36* (2006.01)
*D21H 19/82* (2006.01)
*D21H 23/48* (2006.01)

(52) U.S. Cl.
CPC ..... *D21H 19/36* (2013.01); *D21H 19/82* (2013.01); *D21H 23/48* (2013.01)

(58) Field of Classification Search
CPC ..... D21H 23/48; D21H 19/36; D21H 19/82; D21H 27/10
USPC ..... 162/137
See application file for complete search history.

(56) References Cited

U.S. PATENT DOCUMENTS

| | | | |
|---|---|---|---|
| 6,497,926 | B1 | 12/2002 | Yokota et al. |
| 2010/0239763 | A1 | 9/2010 | Åsmus et al. |
| 2019/0270289 | A1 | 9/2019 | Okamoto et al. |

FOREIGN PATENT DOCUMENTS

| | | | |
|---|---|---|---|
| CN | 103459721 | A | 12/2013 |
| EP | 1416088 | B1 | 2/2010 |
| EP | 3437860 | A1 | 2/2019 |
| JP | S5474761 | A | 6/1979 |
| JP | S5485811 | A | 7/1979 |
| JP | H06294099 | A | 10/1994 |
| JP | 2001018526 | A | 1/2001 |
| JP | 2004148307 | A | 5/2004 |
| JP | 2005270954 | A | 10/2005 |
| JP | 2010529316 | A | 8/2010 |
| JP | 2011178094 | A | 9/2011 |
| WO | 2004035929 | A1 | 4/2004 |
| WO | 2012133091 | A1 | 10/2012 |
| WO | 2013140620 | A1 | 9/2013 |
| WO | 2017170462 | A1 | 10/2017 |

OTHER PUBLICATIONS

JP 2011 178094, Shinichi et al., machine translation, OJI Paper Co., Sep. 15, 2011.*
International Preliminary Report on Patentability, dated Sep. 28, 2021, for corresponding international application PCT/JP2020/013558 (1 page).
Notification Concerning Transmittal of International Preliminary Report on Patentability, dated Oct. 14, 2021, for corresponding international application PCT/JP2020/013558 (1 page).
Notification of Transmittal of Translation of the International Preliminary Report on Patentability, dated Oct. 14, 2021, for corresponding international application PCT/JP2020/013558 (1 page).
Written Opinion of the International Searching Authority, dated Jun. 9, 2020, for corresponding international application PCT/JP2020/013558 (4 page).
Extended European Search Report (EESR) dated Nov. 23, 2022, issued for European counterpart patent application No. EP20781868.3 (7 pages).
International Search Report (ISR) dated Jun. 9, 2020, issued for International application No. PCT/JP2020/013558. (3 pages).

* cited by examiner

*Primary Examiner* — Mark Halpern
(74) *Attorney, Agent, or Firm* — Law Office of Katsuhiro Arai

(57) ABSTRACT

A method for manufacturing a paper barrier base material includes a step of applying a water vapor barrier layer coating liquid that contains at least a water vapor barrier resin and a pigment onto a paper base material by a curtain coating method to form a water vapor barrier layer, and a step of applying a gas barrier layer coating liquid that contains at least one polymer selected from water-soluble polymers and water-dispersible polymers onto the water vapor barrier layer by a curtain coating method without a drying step interposed between the two steps to form a gas barrier layer. The gas barrier layer coating liquid has a B-type viscosity equal to or higher than a B-type viscosity of the water vapor barrier layer coating liquid. The method is intended to suppress the occurrence of coating unevenness in wet-on-wet coating by a curtain coating method.

16 Claims, No Drawings

METHOD FOR MANUFACTURING PAPER BARRIER BASE MATERIAL

CROSS-REFERENCE TO RELATED APPLICATIONS

This application is the U.S. National Phase under 35 U.S.C. § 371 of International Application PCT/JP2020/013558, filed Mar. 26, 2020, which claims priority to Japanese Patent Application No. JP2019-067072, filed Mar. 29, 2019. The International Application was published under PCT Article 21(2) in a language other than English.

TECHNICAL FIELD

The present invention relates to a method for manufacturing a paper barrier base material, in which the occurrence of coating unevenness is suppressed.

BACKGROUND ART

A blade coating method and a roll coating method, which are contact coating methods, are generally used for manufacturing a coating layer.

These contact coating methods have the following features in terms of quality.

The blade coating method is leveling coating (smoothing coating) in which a coating liquid is applied to base paper and an excess coating liquid is then scraped off with a blade to achieve a desired coating quantity, and is a so-called post-metered coating method. Therefore, although the surface of the coating layer has good smoothness, a mottled coating surface is likely to be formed because the coating quantity is affected by irregularities of the base paper. In particular, if the base paper has significant irregularities, the coating liquid is scraped off to such an extent that fibers are exposed at protrusions of the base paper because the surface of the base paper is scratched by a blade. In the coating layer formed by the blade coating method, a difference in layer thickness, which is the distance from the surface of the coating layer to the surface of the base paper, is generated due to such variations in coating quantity. Accordingly, there are problems in that variations in performance depending on the layer thickness are generated and that an internal structure is disordered during scraping, and a predetermined performance is not exhibited. In addition, when the coating liquid passes through the blade, the coating liquid is pressurized by the blade, and water in the coating liquid penetrates into paper. When this water is dried, the paper contracts to cause streaky unevenness, and surface texture of the coating surface may be degraded.

On the other hand, the roll coating method is a so-called pre-metered coating method in which coating is performed by transferring, to base paper, a coating liquid that is metered on a roll in advance. Therefore, there is a problem in that it is necessary to uniformly spread in advance a desired amount of coating liquid over a roll, and a complex machine and operations are required. Furthermore, a streaky pattern is likely to be formed during coating, and it is very difficult to obtain a coating surface without coating unevenness. Thus, the viscosity and the concentration of a coating liquid that can be used are limited. In addition, if foreign matter is mixed on the roll that transfers the coating liquid, there is a concern that a portion of the coating liquid on the roll is not transferred to the base paper.

In addition, an operational feature of these contact coating methods is that the operation efficiency is limited. Specifically, in the contact coating methods, since a blade or a roll comes in contact with base paper with a coating liquid therebetween, a large load is applied to the base paper, and paper breakage is highly likely occur. This tendency increases as the coating speed increases, and the frequency of paper breakage significantly increases. Furthermore, wear of equipment that contacts during coating, i.e., a blade or a roll, is unavoidable, and it is necessary to periodically replace the equipment as consumables. In addition, in the contact coating methods, since the coating equipment is continuously in contact with a coating liquid, dirt is likely to adhere to the coating equipment, and periodical cleaning is necessary in order to suppress the occurrence of coating defects due to the dirt. As described above, the operation efficiency of the contact coating methods is limited. In particular, there is a problem in that the efficiency deteriorates as the coating speed increases.

In contrast to the contact coating methods described above, non-contact coating methods such as a curtain coating method and a spray coating method are known.

The curtain coating method is a coating method in which a coating layer is formed on base paper by forming a curtain film of a coating liquid and passing base paper through the film, and the equipment does not contact the base paper at all during coating. Therefore, in terms of quality, a uniform coating quantity in the width direction and the flow direction is achieved by forming a uniform curtain film of the coating liquid. Because of the non-contact method, the coating liquid can be transferred to the base paper without pressing, a coating layer with a uniform thickness is obtained, and good coatability on the base paper is also achieved. As described above, since a coating layer with a uniform layer thickness is obtained by the curtain coating method, this method is advantageous in that variations in performance depending on the layer thickness are small, and the performance as designed is easily exhibited. In terms of operation, paper breakage during coating is reduced, and no consumables are generated. In addition, the curtain coating method is a pre-metered coating method, in which all the dropped coating liquid is transferred to the base paper. Therefore, it is easy to manage the coating quantity, and coating can be performed in a desired coating quantity by managing the concentration and the flow rate.

Furthermore, since the curtain coating method is a non-contact method as described above, it is possible to perform wet-on-wet coating in which after coating of a lower layer in multilayer coating, coating of an upper layer is performed without a drying step interposed therebetween, which is difficult in a contact coating method. By performing the wet-on-wet coating, the adhesion between the lower layer and the upper layer can be particularly improved.

As described above, the curtain coating method is a very good coating method, and the application of the curtain coating method to, for example, wax coating on pressure-sensitive copying paper (Patent Literature 1), thermal paper (Patent Literature 2), and paperboard has been proposed. A method of introducing the curtain coating method to coated paper for general printing has also been proposed. For example, in order to solve a problem of craters from a coating color surface, a method has been proposed in which a suitable thickening agent is added to a coating liquid to provide a property (spinnability) with which the coating liquid is less likely to be cut even when the coating liquid is elongated (Patent Literature 3).

However, in a case where the wet-on-wet coating is performed by the curtain coating method, unless the viscosity or the like of the coating liquid is controlled to an appropriate range, a coating liquid for a lower layer and a coating liquid for an upper layer are mixed with each other, resulting in the occurrence of "coating unevenness" in which a portion where desired performance is not achieved is locally generated.

CITATION LIST

Patent Literature

PTL 1: Japanese Unexamined Patent Application Publication No. 54-085811

PTL 2: Japanese Unexamined Patent Application Publication No. 54-074761

PTL 3: Japanese Unexamined Patent Application Publication No. 06-294099

SUMMARY OF INVENTION

Technical Problem

An object of the present invention is to provide a method for manufacturing a paper barrier base material, in which the occurrence of coating unevenness in wet-on-wet coating by a curtain coating method is suppressed.

Solution to Problem

The solution to problem in the present invention is as follows.

1. A method for manufacturing a paper barrier base material, including:
   - a step of applying a water vapor barrier layer coating liquid that contains at least a water vapor barrier resin and a pigment onto a paper base material by a curtain coating method to form a water vapor barrier layer; and
   - a step of applying a gas barrier layer coating liquid that contains at least one polymer selected from water-soluble polymers and water-dispersible polymers onto the water vapor barrier layer by a curtain coating method without a drying step interposed between the two steps to form a gas barrier layer,
   - in which the gas barrier layer coating liquid has a B-type viscosity equal to or higher than a B-type viscosity of the water vapor barrier layer coating liquid.
2. The method for manufacturing a paper barrier base material according to 1., in which the gas barrier layer coating liquid has a static surface tension equal to or lower than a static surface tension of the water vapor barrier layer coating liquid.
3. The method for manufacturing a paper barrier base material according to 1. or 2.,
   - in which the water vapor barrier layer coating liquid has a B-type viscosity of 100 mPa·s or more and 400 mPa·s or less at a temperature of 25° C., and
   - the gas barrier layer coating liquid has a B-type viscosity of 150 mPa·s or more and 500 mPa·s or less at a temperature of 25° C.
4. The method for manufacturing a paper barrier base material according to any one of 1. to 3.,
   - in which the water vapor barrier layer coating liquid has a static surface tension of 30 mN/m or more and 40 mN/m or less at a temperature of 25° C., and
   - the gas barrier layer coating liquid has a static surface tension of 25 mN/m or more and 35 mN/m or less at a temperature of 25° C.
5. The method for manufacturing a paper barrier base material according to any one of 1. to 4.,
   - in which the water vapor barrier layer coating liquid has a solid content concentration of 25% by weight or more and 45% by weight or less, and
   - the gas barrier layer coating liquid has a solid content concentration of 15% by weight or more and 35% by weight or less.

Advantageous Effects of Invention

The manufacturing method according to the present invention can suppress the occurrence of coating unevenness in wet-on-wet coating by a curtain coating method.

DESCRIPTION OF EMBODIMENTS

The present invention relates to a method for manufacturing a paper barrier base material, the method including:

- a step of applying a water vapor barrier layer coating liquid that contains at least a water vapor barrier resin and a pigment onto a paper base material by a curtain coating method to form a water vapor barrier layer; and
- a step of applying a gas barrier layer coating liquid that contains at least one polymer selected from water-soluble polymers and water-dispersible polymers onto the water vapor barrier layer by a curtain coating method without a drying step interposed between the two steps to form a gas barrier layer,
- in which the gas barrier layer coating liquid has a B-type viscosity equal to or higher than a B-type viscosity of the water vapor barrier layer coating liquid.

It should be noted that, in the present specification, physical properties such as the B-type viscosity, surface tension, and spinnability of a coating liquid mean physical properties of the coating liquid under actual coating conditions (such as a temperature, a solid content concentration, and the like) unless the temperature, the solid content concentration, and the like of the coating liquid are limited.

"Method for Manufacturing Paper Barrier Base Material"

A paper barrier base material is manufactured by applying a water vapor barrier layer coating liquid that contains at least a water vapor barrier resin and a pigment onto a paper base material by a curtain coating method to form a water vapor barrier layer, and applying a gas barrier layer coating liquid that contains at least one polymer selected from water-soluble polymers and water-dispersible polymers onto the water vapor barrier layer by a curtain coating method without a drying step interposed therebetween to form a gas barrier layer. In the manufacturing method according to the present invention, the gas barrier layer coating liquid has a B-type viscosity equal to or higher than a B-type viscosity of the water vapor barrier layer coating liquid.

The at least one polymer selected from water-soluble polymers and water-dispersible polymers and contained in the gas barrier layer in the present invention is hydrophilic. Therefore, when the gas barrier layer is applied by a curtain coating method without a drying step after the formation of the water vapor barrier layer by the curtain coating method, if the gas barrier layer coating liquid is mixed with the water vapor barrier layer coating liquid for the lower layer, the water vapor barrier property is deteriorated, and the gas barrier property is also deteriorated.

In the present invention, since the B-type viscosity of the gas barrier layer coating liquid is equal to or higher than the B-type viscosity of the water vapor barrier layer coating liquid, even when the gas barrier layer coating liquid is applied onto an undried water vapor barrier layer (water vapor barrier layer coating liquid), it is possible to suppress mixing of the water vapor barrier layer coating liquid and the gas barrier layer coating liquid and to obtain a paper barrier material having a good water vapor barrier property and a good gas barrier property.

The difference between the B-type viscosity of the gas barrier layer coating liquid and the B-type viscosity of the water vapor barrier layer coating liquid is preferably 10 mPa·s or more, more preferably 30 mPa·s or more, more preferably 100 mPa·s or more, and still more preferably 150 mPa·s or more. The difference between the B-type viscosity of the gas barrier layer coating liquid and the B-type viscosity of the water vapor barrier layer coating liquid is preferably 220 mpa·s or less. If the difference between the B-type viscosity of the gas barrier layer coating liquid and the B-type viscosity of the water vapor barrier layer coating liquid exceeds 220 mPa·s, for example, operability and adhesion between the layers may be degraded.

The gas barrier layer coating liquid used in the present invention preferably has a static surface tension equal to or lower than a static surface tension of the water vapor barrier layer coating liquid. When the static surface tension of the gas barrier layer coating liquid is equal to or lower than the static surface tension of the water vapor barrier layer coating liquid, mixing of the gas barrier layer coating liquid and the water vapor barrier layer coating liquid can be effectively suppressed. The difference between the static surface tension of the gas barrier layer coating liquid and the static surface tension of the water vapor barrier layer coating liquid (gas barrier layer coating liquid-water vapor barrier layer coating liquid) is preferably −3 mN/s or less and more preferably −5 mN/s or less.

In the present invention, the properties such as the B-type viscosity and the static surface tension of the water vapor barrier layer coating liquid and the gas barrier layer coating liquid can be adjusted by, for example, the amounts of a viscosity modifier, a water repellent, a surface-active agent, and the like added and the blending ratios of the water vapor barrier resin, the water-soluble polymer, the water-dispersible polymer, the pigment, and the like contained in the coating liquids.

The curtain coating method is a coating method in which a coating liquid is allowed to flow down in a curtain shape to form a curtain film, and a base material is passed through the curtain film to thereby provide a coating layer on the base material. The curtain coating method is contour coating in which a coating layer is formed along a base material and is a so-called pre-metered method as described above. Thus, the curtain coating method has a feature that the coating quantity is easily controlled.

In the present invention, a known machine used in the curtain coating method can be used. It is possible to use any coating machine such as a slot-type curtain coating machine in which a curtain film is directly formed by discharging a coating liquid downward from a die, and a slide-type curtain coating machine in which a curtain film is formed by discharging a coating liquid upward from a die, allowing the coating liquid to flow while forming a film of the coating liquid on an inclined surface of the die, and then allowing the coating liquid to leave from the die and to freely fall.

(Water Vapor Barrier Layer Coating Liquid)

The water vapor barrier layer coating liquid is a coating liquid that contains at least a water vapor barrier resin and a pigment and that is primarily composed of water in which the water vapor barrier resin and the pigment are dissolved and dispersed. The water vapor barrier layer coating liquid in the present invention contains at least a water vapor barrier resin and a pigment and may further contain, for example, a water-soluble polymer, a water repellent, a surface-active agent, a crosslinking agent, and a viscosity modifier described in detail below.

The water vapor barrier layer coating liquid used in the preset invention preferably has a B-type viscosity in a range of 100 mPa·s or more and 400 mPa·s or less at a temperature of 25° C. If the B-type viscosity at a temperature of 25° C. is lower than 100 mPa·s, the coating liquid may excessively penetrate into the base material, and the quality of the resulting paper barrier base material may be degraded. If the B-type viscosity at a temperature of 25° C. is higher than 400 mPa·s, operational problems such as a poor liquid feed property and poor handleability of the coating liquid are likely to occur. The B-type viscosity of a coating liquid is a value measured at a predetermined temperature with a Brookfield viscometer (B-type viscometer) using a No. 3 rotor at a rotation speed of 60 rpm.

The water vapor barrier layer coating liquid used in the preset invention preferably has a static surface tension of 40 mN/m or less at a temperature of 25° C. In the manufacturing method according to the present invention, when the static surface tension of the water vapor barrier layer coating liquid at a temperature of 25° C. is 40 mN/m or less, the stability of a curtain film flowing down from a die increases, and even at a low flow rate, neck-in and film breakage of the curtain film can be suppressed to provide a uniform and stable curtain film. The static surface tension at a temperature of 25° C. is preferably 30 mN/m or more. If the static surface tension at a temperature of 25° C. is less than 30 mN/m, the water vapor barrier layer coating liquid excessively penetrates into the base material due to excessive wettability of the water vapor barrier layer coating liquid to the base material, which may result in deterioration of the water vapor barrier property. The static surface tension of the coating liquid is a value measured by the plate method (Wilhelmy method) at a predetermined temperature. An example of a surface tensiometer capable of performing such measurement is a fully automatic surface tensiometer (model name: CBVP-Z) manufactured by Kyowa Interface Science Co., Ltd.

The water vapor barrier layer coating liquid used in the present invention preferably has a spinnability of 0.07 seconds or more and 0.4 seconds or less at a temperature of 25° C. In the curtain coating method, at the moment when a curtain film comes into contact with a base material, the curtain film is pulled by the base material and extended due to the difference between a falling speed of the curtain film and a traveling speed of the base material. When the spinnability of the coating liquid is within this range, the curtain film can follow this extension, and a stable curtain film is easily formed.

Herein, the spinnability of a coating liquid is an index of the ease of extension of the coating liquid and is a value measured by an extensional viscometer. Specifically, the spinnability is determined by: 1) using a viscometer that includes a pair of circular plates having a diameter of 8 mm and arranged coaxially such that the axis is perpendicular, and enclosing a coating liquid at a predetermined temperature between the plates (gap: 1 mm), 2) pulling up the upper plate perpendicularly by 8 mm at a speed of 400 mm/sec and holding the plate as it is, and 3) measuring the time from the start of pulling up of the plate to the occurrence of breakage of a coating liquid filament. The time before the filament is broken is preferably measured by a laser, and the time resolution at this time is preferably about 2 ms. Examples of the extensional viscometer capable of performing such measurement include an extensional viscometer (model name: CaBER 1) manufactured by Thermo Haake Inc.

The solid content concentration of the water vapor barrier layer coating liquid used in the present invention is not particularly limited, but is preferably 25% by weight or more and more preferably 30% by weight or more. The upper limit of the solid content concentration is also not particularly limited, but is preferably 45% by weight or less and more preferably 40% by weight or less in consideration of, for example, a liquid feed property.

(Water Vapor Barrier Resin)

The water vapor barrier resin may be, for example, a synthetic adhesive such as a styrene-butadiene, styrene-acrylic, ethylene-vinyl acetate, paraffin (WAX), butadiene-methyl methacrylate, or vinyl acetate-butyl acrylate copolymer, a maleic anhydride copolymer, or an acrylic acid-methyl methacrylate copolymer; or a paraffin (WAX)-blended synthetic adhesive thereof. These may be used alone or as a mixture of two or more thereof. Of these, styrene-butadiene synthetic adhesives and styrene-acrylic synthetic adhesives are preferably used in view of the water vapor barrier property. In the present invention, the styrene-butadiene synthetic adhesives refer to adhesives obtained by subjecting styrene and butadiene serving as main constituent monomers to emulsion polymerization in combination with various comonomers for modification. Examples of the comonomer include methyl methacrylate, acrylonitrile, acrylamide, hydroxyethyl acrylate, and unsaturated carboxylic acids such as itaconic acid, maleic acid, and acrylic acid. As the emulsifier, an anionic surface-active agent such as sodium oleate, rosin acid soap, a sodium alkyl allyl sulfonate, or sodium dialkylsulfosuccinate may be used alone or in combination with a nonionic surface-active agent. An amphoteric or cationic surface-active agent may also be used depending on the purpose. The styrene-acrylic synthetic adhesives refer to adhesives obtained by subjecting styrene and acryl serving as main constituent monomers to emulsion polymerization in combination with various comonomers for modification.

(Water-Soluble Polymer)

Water-soluble polymers such as polyvinyl alcohols, e.g., fully saponified polyvinyl alcohol, partially saponified polyvinyl alcohol, and ethylene-copolymerized polyvinyl alcohol; proteins, e.g., casein, soybean protein, and synthetic proteins; starches, e.g., oxidized starch, cationic starch, urea phosphate esterified starch, and hydroxyethyl etherified starch; cellulose derivatives, e.g., carboxymethyl cellulose, hydroxymethyl cellulose, and hydroxyethyl cellulose; polyvinylpyrrolidone; and sodium alginate may be used in combination with the water vapor barrier resin as long as there is substantially no problem in the water vapor barrier property.

(Pigment)

The pigment increases the water vapor barrier property of the water vapor barrier layer and can improve the adhesion between the water vapor barrier layer and the gas barrier layer when the gas barrier layer is formed on the water vapor barrier layer by coating.

The pigment may be, for example, an inorganic pigment such as kaolin, clay, engineered kaolin, delaminated clay, ground calcium carbonate, precipitated calcium carbonate, mica, talc, titanium dioxide, barium sulfate, calcium sulfate, zinc oxide, silicic acid, a silicate, colloidal silica, or satin white; or a solid, hollow, or core-shell type organic pigment. These pigments may be used alone or as a mixture of two or more thereof.

Of these pigments, inorganic pigments such as kaolin, mica, and talc, which have a flat shape, are preferable, and kaolin and mica are more preferable from the viewpoints of both improving the water vapor barrier property and reducing the penetration of the gas barrier layer coating liquid. Of these, inorganic pigments having an aspect ratio of 10 or more are preferably used alone or as a mixture of two or more thereof. The aspect ratio is more preferably 100 or more and still more preferably 200 or more. In addition, inorganic pigments having a 50% volume-average particle size (D50) (hereinafter also referred to as an "average particle size") of 5 μm or more are preferably used alone or as a mixture of two or more thereof. If the average particle size or the aspect ratio of the inorganic pigment used is smaller than the above range, the effect of improving the water vapor barrier property is reduced.

In the present invention, a pigment having an average particle size of 5 μm or less may be further contained in the water vapor barrier layer that contains an inorganic pigment having an average particle size of 5 μm or more to improve the water vapor barrier property and to improve the adhesion to the gas barrier layer. By using the pigment having an average particle size of 5 μm or less in combination, voids in the water vapor barrier layer, the voids being formed by the inorganic pigment having an average particle size of 5 μm or more, can be reduced. Thus, a better water vapor barrier property is exhibited. Specifically, in a case where a pigment having a different average particle size is contained in the water vapor barrier layer, the pigment having a small average particle size fills voids formed by an inorganic pigment having a large average particle size in the water vapor barrier layer, and water vapor bypasses the pigment to pass through the water vapor barrier layer. Thus, it is surmised that the water vapor barrier layer has a higher water vapor barrier property than a water vapor barrier layer that does not contain such a pigment having a different average particle size.

In the present invention, in a case where an inorganic pigment having an average particle size of 5 μm or more and a pigment having an average particle size of 5 μm or less are used in combination, a blending ratio of the inorganic pigment having an average particle size of 5 μm or more to the pigment having an average particle size of 5 μm or less is preferably 50/50 to 99/1 on a dry weight basis. If the blending ratio of the inorganic pigment having an average particle size of 5 μm or more is smaller than the above range, the number of times water vapor bypasses the water vapor barrier layer is reduced and the distance of the movement is shortened. Consequently, the effect of improving the water vapor barrier property may be reduced. On the other hand, if the blending ratio of the inorganic pigment having an average particle size of 5 μm or more is larger than the above range, the voids formed by the inorganic pigment having a large average particle size in the water vapor barrier layer cannot be sufficiently filled with the pigment having an average particle size of 5 μm or less. Therefore, a further improvement in the water vapor barrier property is not achieved.

In the present invention, the pigment having an average particle size of 5 μm or less and used in combination with the inorganic pigment having an average particle size of 5 μm or more may be, for example, an inorganic pigment such as kaolin, clay, engineered kaolin, delaminated clay, ground calcium carbonate, precipitated calcium carbonate, talc, titanium dioxide, barium sulfate, calcium sulfate, zinc oxide, silicic acid, a silicate, colloidal silica, or satin white; or a solid, hollow, or core-shell type organic pigment. These pigments may be used alone or as a mixture of two or more thereof. Of these pigments, ground calcium carbonate is preferably used.

When a pigment is contained in the water vapor barrier layer, the blending quantity of the total of the water vapor barrier resin and the water-soluble polymer relative to the pigment is, on a dry weight basis, preferably in a range of 5 parts by weight or more and 200 parts by weight or less, and more preferably 10 parts by weight or more and 150 parts by weight or less relative to 100 parts by weight of the pigment.

(Water Repellent)

In the present invention, from the viewpoint of improving the water vapor barrier property, a water repellent may be contained in the water vapor barrier layer. Examples of the water repellent include paraffin water repellents primarily constituted by alkane compounds; natural oil water repellents derived from animal or plant, such as carnauba and lanolin; silicone-containing water repellents that contain silicone or a silicone compound; and fluorine-containing water repellents that contain a fluorine compound. Of these, paraffin water repellents are preferably used from the viewpoint of exhibiting the water vapor barrier performance. These water repellents may be used alone or as a mixture of two or more thereof.

In the present invention, the blending quantity of the water repellent is not particularly limited, but the blending quantity of the water repellent is, on a dry weight basis, preferably 20 parts by weight or more and 100 parts by weight or less, and more preferably 30 parts by weight or more and 80 parts by weight or less relative to 100 parts by weight of the pigment in the water vapor barrier layer. If the blending quantity of the water repellent is less than 20 parts by weight, the effect of improving the water vapor barrier property may not be sufficiently achieved. On the other hand, if the blending quantity of the water repellent exceeds 100 parts by weight, in a case where a gas barrier layer is provided on the water vapor barrier layer, it becomes difficult to uniformly form the gas barrier layer, which may result in deterioration of the gas barrier property.

(Surface-Active Agent)

In the present invention, from the viewpoint of an improvement in the leveling property of the water vapor barrier layer coating liquid and the adhesion to the gas barrier layer, a surface-active agent may be contained in the water vapor barrier layer. The ionic property of the surface-active agent is not limited, and any type of surface-active agent such as an anionic surface-active agent, a cationic surface-active agent, an amphoteric surface-active agent, or a nonionic surface-active agent may be used. These surface-active agents may be used alone or in combination of two or more thereof. Examples of the specific type of surface-active agent include silicone surface-active agents, fluorine surface-active agents, alcohol surface-active agents, acetylene surface-active agents having an acetylene group, acetylene diol surface-active agents having an acetylene group and two hydroxyl groups, alkyl sulfonate surface-active agents having an alkyl group and a sulfonic acid, ester surface-active agents, amide surface-active agents, amine surface-active agents, alkyl ether surface-active agents, phenyl ether surface-active agents, sulfate ester surface-active agents, and phenol surface-active agents. Of these, acetylene diol surface-active agents, which exhibit a high effect of improving the leveling property of the water vapor barrier layer coating liquid, are preferably used. The improvement in the leveling property of the water vapor barrier layer coating liquid improves the uniformity of the resulting water vapor barrier layer and facilitates the formation of a uniform gas barrier layer when the gas barrier layer is provided on the water vapor barrier layer. Consequently, the adhesion between the water vapor barrier layer and the gas barrier layer is improved, and both the water vapor barrier property and the gas barrier property tend to be improved.

In the present invention, the blending quantity of the surface-active agent is not particularly limited, but the blending quantity of the surface-active agent is, on a dry weight basis, preferably 0.3 parts by weight or more and 3.0 parts by weight or less, and more preferably 0.3 parts by weight or more and 2.0 parts by weight or less relative to 100 parts by weight of the pigment in the water vapor barrier layer. If the blending quantity of the surface-active agent is less than 0.3 parts by weight, the effect of improving the leveling property of the water vapor barrier layer coating liquid may not be sufficiently achieved. On the other hand, if the blending quantity of the surface-active agent exceeds 3.0 parts by weight, the effect of improving the leveling property of the water vapor barrier layer coating liquid may be saturated, and the water vapor barrier property may be deteriorated.

(Crosslinking Agent)

In the present invention, a crosslinking agent typified by a polyvalent metal salt or the like may be added to the water vapor barrier layer. Since the crosslinking agent causes a crosslinking reaction with a water vapor barrier resin or water-soluble polymer contained in the water vapor barrier layer, the number of bonds (crosslinked points) in the water vapor barrier layer increases. That is, the water vapor barrier layer has a dense structure and can exhibit a good water vapor barrier property.

In the present invention, the type of crosslinking agent is not particularly limited, and it is possible to appropriately select and use a polyvalent metal salt (compound in which a polyvalent metal such as copper, zinc, silver, iron, potassium, sodium, zirconium, aluminum, calcium, barium, magnesium, or titanium is bound to an ionic substance such as a carbonate ion, a sulfate ion, a nitrate ion, a phosphate ion, a silicate ion, a nitrogen oxide, or a boron oxide), an amine compound, an amide compound, an aldehyde compound, a hydroxy acid, or the like in accordance with the types of the water vapor barrier resin and water-soluble polymer contained in the water vapor barrier layer.

In a case of using a styrene water vapor barrier resin such as a styrene-butadiene or a styrene-acrylic resin, which exhibits a good effect in the water-vapor barrier property, a polyvalent metal salt is preferably used, and potassium alum is more preferably used from the viewpoint of exhibiting the crosslinking effect. The blending quantity of the crosslinking agent is not particularly limited within a range of a coatable coating liquid concentration or coating liquid viscosity. The blending quantity of the crosslinking agent is preferably 1 part by weight or more and 10 parts by weight or less and more preferably 3 parts by weight or more and 5 parts by weight or less relative to 100 parts by weight of the pigment. If the blending quantity is less than 1 part by weight, the effect of adding the crosslinking agent may not be sufficiently achieved. If the blending quantity is more than 10 parts by weight, the viscosity of the coating liquid may significantly increase, resulting in a difficulty of coating.

In the present invention, in a case where the crosslinking agent is added to the water vapor barrier layer coating liquid, it is preferable that the crosslinking agent be dissolved in a polar solvent such as ammonia and then added to the coating liquid. When the crosslinking agent is dissolved in the polar solvent, a bond is formed between the crosslinking agent and the polar solvent. Therefore, a crosslinking reaction with the water vapor barrier resin or the water-soluble polymer does not occur immediately after the addition of the crosslinking agent to the coating liquid. Thus, an increase in the viscosity of the coating liquid can be suppressed. It is supposed that, in such a case, the polar solvent component is volatilized by drying after coating on the paper base material, a crosslinking reaction with the water vapor barrier resin or the water-soluble polymer occurs, and a dense water vapor barrier layer is formed.

(Viscosity Modifier)

In the present invention, the water vapor barrier layer coating liquid preferably contains a viscosity modifier. The viscosity modifier is a chemical agent having an action of adjusting the flowability of the coating liquid. Containing the viscosity modifier makes it easy to control the spinnability of the water vapor barrier layer coating liquid to a desired value.

Specific examples of the viscosity modifier include hydrophilic polymers such as polyvinylpyrrolidone resins, polyvinyl alcohol resins, cellulose resins, polyacrylamide resins, and poly(meth)acrylic acid resins. Of these, ethylene-modified polyvinyl alcohol and sodium polyacrylate are preferred because the degree of deterioration of the water vapor barrier property due to the addition of the viscosity modifier is low and coating suitability by the curtain coating method is good. In particular, ethylene-modified polyvinyl alcohol is preferable because ethylene-modified polyvinyl alcohol is a hydrophobic group-introduced polymer and thus has less influence on the water vapor barrier property despite being a hydrophilic polymer.

Since the viscosity modifier is hydrophilic, a large amount of viscosity modifier added may deteriorate the water vapor barrier property. In addition, since the stability and continuous operability of the coating liquid also tend to decrease, the amount of viscosity modifier added is preferably small as long as the spinnability of the water vapor barrier layer coating liquid can be 0.07 seconds or more. For example, the amount of ethylene-modified polyvinyl alcohol added is preferably 1% by weight or more and 20% by weight or less, and more preferably 1% by weight or more and 10% by weight or less in terms of solid content relative to the pigment in the water vapor barrier layer coating liquid. The amount of sodium polyacrylate added is preferably 0.01% by weight or more and 0.5% by weight or less, and more preferably 0.01% by weight or more and 0.1% by weight or less in terms of solid content relative to the pigment in the water vapor barrier layer coating liquid.

In the water vapor barrier layer coating liquid, in addition to the water vapor barrier resin, the water-soluble polymer, the pigment, the water repellent, the surface-active agent, the crosslinking agent, and the viscosity modifier described above, various commonly used auxiliary agents such as a dispersant, an antifoaming agent, a water-resistant agent, a dye, and a fluorescent dye may be used.

In the present invention, the coating quantity of the water vapor barrier layer is preferably 3 $g/m^2$ or more and 50 $g/m^2$ or less, more preferably 5 $g/m^2$ or more and 40 $g/m^2$ or less, and still more preferably 7 $g/m^2$ or more and 30 $g/m^2$ or less on a dry weight basis. If the coating quantity of the water vapor barrier layer is less than 3 $g/m^2$, it becomes difficult to completely cover the paper base material with the coating liquid, and thus a sufficient water vapor barrier property may not be achieved or when the gas barrier layer coating liquid is applied onto the water vapor barrier layer, the gas barrier layer coating liquid may penetrate into the paper base material, and thus a sufficient gas barrier property may not be achieved. On the other hand, if the coating quantity of the water vapor barrier layer is larger than 50 $g/m^2$, the drying load in coating increases.

It should be noted that, in the present invention, the water vapor barrier layer may be formed of a single layer or may have a multilayer structure including two or more layers. In a case where the water vapor barrier layer has a multilayer structure including two or more layers, the total coating quantity of all the water vapor barrier layers is preferably within the above range.

(Gas Barrier Layer Coating Liquid)

The gas barrier layer coating liquid is a coating liquid that contains at least one polymer selected from water-soluble polymers and water-dispersible polymers and that is primarily composed of water in which these polymers are dissolved and dispersed, and is characterized in that a B-type viscosity thereof is equal to or higher than the B-type viscosity of the water vapor barrier layer coating liquid. The gas barrier layer coating liquid in the present invention contains at least one polymer selected from at least water-soluble polymers and water-dispersible polymers and may further contain, for example, a pigment, a crosslinking agent, and a surface-active agent described in detail below.

The gas barrier layer coating liquid used in the present invention has a B-type viscosity equal to or higher than the B-type viscosity of the water vapor barrier layer coating liquid. The B-type viscosity of the gas barrier layer coating liquid is not particularly limited as long as the B-type viscosity is equal to or higher than the B-type viscosity of the water vapor barrier layer coating liquid. The B-type viscosity at a temperature of 25° C. is preferably in a range of 150 mPa·s or more and 500 mPa·s or less. If the B-type viscosity at a temperature of 25° C. is lower than 150 mPa·s, the gas barrier layer coating liquid is likely to be mixed with the water vapor barrier layer coating liquid, and coating unevenness may be likely to occur. If the B-type viscosity at a temperature of 25° C. is higher than 500 mPa·s, operational problems such as a poor liquid feed property and poor handleability of the coating liquid are likely to occur.

The gas barrier layer coating liquid used in the preset invention preferably has a static surface tension of 25 mN/m or more and 35 mN/m or less at a temperature of 25° C. When the static surface tension of the coating liquid at a temperature of 25° C. is within this range, it is possible to suppress neck-in of the curtain film (a phenomenon in which unevenness of the film thickness is generated at a central portion and end portions in the width direction of a base material due to an attempt to reduce the curtain film width by the surface tension of the coating liquid) and to provide a uniform and stable curtain film.

The gas barrier layer coating liquid used in the present invention preferably has a spinnability of 0.07 seconds or more and 0.4 seconds or less at a temperature of 25° C. When the spinnability of the coating liquid at a temperature of 25° C. is within this range, the curtain film can follow the extension of a base material at the moment when the curtain film comes into contact with the base material, and a stable curtain film is easily formed.

The solid content concentration of the gas barrier layer coating liquid used in the present invention is not particularly limited, but is preferably 15% by weight or more and 35% by weight or less.

(Water-Soluble Polymer/Water-Dispersible Polymer)

The gas barrier layer contains at least one polymer selected from water-soluble polymers and water-dispersible polymers.

Examples of the water-soluble polymer include polyvinyl alcohols such as fully saponified polyvinyl alcohol, partially saponified polyvinyl alcohol, and ethylene-copolymerized polyvinyl alcohol; proteins such as casein, soybean protein, and synthetic proteins; starches such as oxidized starch, cationic starch, urea phosphate esterified starch, and hydroxyethyl etherified starch; cellulose derivatives such as carboxymethyl cellulose, hydroxymethyl cellulose, and hydroxyethyl cellulose; polyvinylpyrrolidone; and sodium alginate. Of these, polyvinyl alcohols and cellulose derivatives are preferable, and polyvinyl alcohols are more preferable from the viewpoint of the gas barrier property.

Examples of the water-dispersible polymer include polyvinylidene chloride, ethylene vinyl acetate resins, and modified polyolefin resins.

One or both of the water-soluble polymer and the water-dispersible polymer may be used. With regard to each of the water-soluble polymer and the water-dispersible polymer, polymers may be used alone or as a mixture of two or more thereof.

(Pigment)

In the present invention, containing a pigment in the gas barrier layer is preferable from the viewpoint of improving the gas barrier property. The pigment used in the gas barrier layer may be, for example, an inorganic pigment such as kaolin, clay, engineered kaolin, delaminated clay, ground calcium carbonate, precipitated calcium carbonate, mica, talc, titanium dioxide, barium sulfate, calcium sulfate, zinc oxide, silicic acid, a silicate, colloidal silica, or satin white; or a solid, hollow, or core-shell type organic pigment. These pigments may be used alone or as a mixture of two or more thereof.

Of these pigments, inorganic pigments such as kaolin, mica, and talc, which have a flat shape, are preferable, and kaolin and mica are more preferable from the viewpoint of improving the gas barrier property. An inorganic pigment having an average particle size of 3 μm or more is more preferably used, and an inorganic pigment having an average particle size of 5 μm or more is still more preferably used. An inorganic pigment having an aspect ratio of 10 or more is more preferably used, and an inorganic pigment having an aspect ratio of 30 or more is still more preferably used.

In a case where a pigment is contained in the gas barrier layer, a gas such as oxygen bypasses the pigment to pass through the gas barrier layer. Therefore, the gas barrier layer has a better gas barrier property under a high-humidity atmosphere than a gas barrier layer composed of a polymer such as a water-soluble polymer and/or a water-dispersible polymer that does not contain a pigment.

In the present invention, when a pigment is contained in the gas barrier layer, the blending ratio of the pigment to the water-soluble polymer and the water-dispersible polymer is preferably pigment/(total of water-soluble polymer and water-dispersible polymer)=1/100 to 1000/100 on a dry weight basis. If the ratio of the pigment is out of the above range, the effect of improving the gas barrier property may be reduced.

It should be noted that, in the present invention, in blending the pigment in the water-soluble polymer and the water-dispersible polymer, the pigment is preferably added to and mixed with the polymers in the form of a slurry.

(Crosslinking Agent)

In the present invention, a crosslinking agent typified by a polyvalent metal salt or the like may be added to the gas barrier layer. Since the crosslinking agent causes a crosslinking reaction with a polymer such as a water-soluble polymer or water-dispersible polymer contained in the gas barrier layer, the number of bonds (crosslinked points) in the gas barrier layer increases. That is, the gas barrier layer has a dense structure and can exhibit a good gas barrier property.

In the present invention, the type of crosslinking agent is not particularly limited, and it is possible to appropriately select and use a polyvalent metal salt (compound in which a polyvalent metal such as copper, zinc, silver, iron, potassium, sodium, zirconium, aluminum, calcium, barium, magnesium, or titanium is bound to an ionic substance such as a carbonate ion, a sulfate ion, a nitrate ion, a phosphate ion, a silicate ion, a nitrogen oxide, or a boron oxide), an amine compound, an amide compound, an aldehyde compound, a hydroxy acid, or the like in accordance with the type of polymer such as the water-soluble polymer or water-dispersible polymer contained in the gas barrier layer. From the viewpoint of exhibiting the crosslinking effect, a polyvalent metal salt is preferably used, and potassium alum is more preferably used.

The blending quantity of the crosslinking agent is not particularly limited within a range of a coatable coating liquid concentration or coating liquid viscosity. The blending quantity of the crosslinking agent is preferably 1 part by weight or more and 10 parts by weight or less and more preferably 3 parts by weight or more and 5 parts by weight or less relative to 100 parts by weight of the pigment. If the blending quantity is less than 1 part by weight, the effect of adding the crosslinking agent may not be sufficiently achieved. If the blending quantity is more than 10 parts by weight, the viscosity of the coating liquid may significantly increase, resulting in a difficulty of coating.

(Surface-Active Agent)

In the present invention, a surface-active agent is preferably contained in the gas barrier layer from the viewpoint of adhesion to the water vapor barrier layer. The ionic property of the surface-active agent is not limited, and any type of surface-active agent such as an anionic surface-active agent, a cationic surface-active agent, an amphoteric surface-active agent, or a nonionic surface-active agent may be used. These surface-active agents may be used alone or in combination of two or more thereof. Examples of the specific type of surface-active agent include silicone surface-active agents, fluorine surface-active agents, alcohol surface-active agents, acetylene surface-active agents having an acetylene group, acetylene diol surface-active agents having an acetylene group and two hydroxyl groups, alkyl sulfonate surface-active agents having an alkyl group and a sulfonic acid, ester surface-active agents, amide surface-active agents, amine surface-active agents, alkyl ether surface-active agents, phenyl ether surface-active agents, sulfate ester surface-active agents, and phenol surface-active agents. Of these, acetylene diol surface-active agents, which exhibit a high effect of improving the leveling property of the coating liquid, are preferably used. The improvement in the leveling property of the coating liquid improves uniformity of the gas barrier layer, and thus the gas barrier property is improved.

In the gas barrier layer in the present invention, in addition to the at least one polymer selected from water-soluble polymers and water-dispersible polymers, the pigment, the crosslinking agent, and the surface-active agent described above, various commonly used auxiliary agents such as a dispersant, a thickening agent, a water-retention agent, an antifoaming agent, a water-resistant agent, a dye, and a fluorescent dye may be used.

In the present invention, the coating quantity of the gas barrier layer is preferably 0.2 $g/m^2$ or more and 20 $g/m^2$ or less on a dry weight basis. If the coating quantity of the gas barrier layer is less than 0.2 $g/m^2$, it is difficult to form a uniform gas barrier layer, and thus a sufficient gas barrier property may not be achieved. On the other hand, if the coating quantity of the gas barrier layer is larger than 20 $g/m^2$, the drying load in coating increases.

It should be noted that, in the present invention, the gas barrier layer may be formed of a single layer or may have a multilayer structure including two or more layers. In a case where the gas barrier layer has a multilayer structure including two or more layers, the total coating quantity of all the gas barrier layers is preferably within the above range.

(Paper Base Material)

In the present invention, the paper base material is a sheet composed of pulp, a filler, various auxiliary agents, and the like.

The pulp used may be, for example, chemical pulp such as hardwood bleached kraft pulp (LBKP), softwood bleached kraft pulp (NBKP), hardwood unbleached kraft pulp (LUKP), softwood unbleached kraft pulp (NUKP), or sulfite pulp; mechanical pulp such as stone groundwood pulp or thermo-mechanical pulp; wood fibers such as de-inked pulp or recycled paper pulp; or non-wood fibers derived from kenaf, bamboo, hemp, or the like. The pulp may be used in combination as appropriate. Of these, chemical pulp or mechanical pulp is preferably used, and chemical pulp is more preferably used because, for example, foreign matter is unlikely to be mixed into the base paper, discoloration over time is unlikely to occur when used paper containers are supplied as a used paper raw material and used for recycling, and good surface texture is obtained when printed because the above pulp has a high degree of whiteness, and consequently, high value is added particularly when the pulp is used as a packaging material.

The filler used may be known filler such as white carbon, talc, kaolin, clay, ground calcium carbonate, precipitated calcium carbonate, titanium oxide, zeolite, or synthetic resin filler. In addition, internal auxiliary agents for papermaking, such as aluminum sulfate or any of various anionic, cationic, nonionic, or amphoteric retention aids, drainage aids, paper strengthening agents, and internal sizing agents may be used, as necessary. Furthermore, for example, dyes, fluorescent whitening agents, pH adjusting agents, antifoaming agents, pitch control agents, and slime control agents may also be added, as necessary.

The method for manufacturing a paper base material (papermaking) is not particularly limited. The paper base material can be manufactured according to the acidic papermaking, neutral papermaking, or alkaline papermaking method using any known machine such as a Fourdrinier former, on-top hybrid former, or gap former machine. The paper base material may be formed of a single layer or may have a multilayer structure including two or more layers.

Furthermore, the surface of the paper base material can be treated with various chemical agents. Examples of chemical agents that may be used include oxidized starch, hydroxyethyl etherified starch, enzyme-modified starch, polyacrylamide, polyvinyl alcohol, surface sizing agents, water-resistant agents, water-retention agents, thickening agents, and lubricants. These chemical agents may be used alone or as a mixture of two or more thereof. Furthermore, these various chemical agents may be used in combination with pigments. The pigment may be, for example, an inorganic pigment such as kaolin, clay, engineered kaolin, delaminated clay, ground calcium carbonate, precipitated calcium carbonate, mica, talc, titanium dioxide, barium sulfate, calcium sulfate, zinc oxide, silicic acid, a silicate, colloidal silica, or satin white; or a solid, hollow, or core-shell type organic pigment. These pigments may be used alone or as a mixture of two or more thereof.

The method for treating the surface of the paper base material is not particularly limited. Any known coating machine such as a rod-metering size press, a pond size press, a gate-roll coater, a spray coater, a blade coater, or a curtain coater may be used.

Examples of the paper base material obtained in this manner include various known paper base materials such as high-quality paper, medium quality paper, coated paper, one side glossy paper, kraft paper, one side glossy kraft paper, bleached kraft paper, glassine paper, paperboard, white paperboard, and liner.

The grammage of the paper base material can be appropriately selected in accordance with, for example, various qualities desired for the paper barrier base material and handleability but is usually preferably about 20 $g/m^2$ or more and about 500 $g/m^2$ or less. In a case of a paper barrier packaging material used for packaging applications such as packaging materials, containers, and cups for food and the like, a paper barrier packaging material having a grammage of 25 $g/m^2$ or more and 400 $g/m^2$ or less is more preferable. In particular, in a case of a paper barrier packaging material used for soft packaging materials described later, a paper barrier packaging material having a grammage of 30 $g/m^2$ or more and 110 $g/m^2$ or less is more preferable.

(Paper Barrier Base Material)

A paper barrier base material according to the present invention is manufactured by at least applying a water vapor barrier layer coating liquid onto a paper base material by a curtain coating method, applying a gas barrier layer coating liquid by a curtain coating method without a drying step interposed therebetween, and then performing a usual drying step. In a preferred embodiment, the paper barrier base material is finished such that the water content of the coated paper after manufacturing becomes about 3% by weight or more and about 10% by weight or less, more preferably about 4% by weight or more and about 8% by weight or less.

As a method for drying the water vapor barrier layer and the gas barrier layer, for example, a usual method using a steam heater, a gas heater, an infrared heater, an electric heater, a hot air heater, microwaves, a cylinder drier, or the like is employed. For the smoothing process, a typical smoothing device such as a super calender, a gloss calender, a soft calender, a thermal calender, or a shoe calender can be used. The smoothing device is appropriately used on-machine or off-machine, and the form of a pressing device, the number of pressing nips, heating, and the like are also appropriately adjusted.

The paper barrier base material according to the present invention may be used without further treatment, or laminated with a resin or the like, or may be attached to a general-purpose film, a barrier film, aluminum foil, or the like to form a paper barrier packaging material used for packaging applications such as packaging materials, containers, and cups for food and the like, or a laminate used for, for example, industrial materials.

Of these, the paper barrier base material according to the present invention can be suitably used as a paper barrier packaging material used for packaging applications such as packaging materials, containers, and cups for food and the like and can be particularly suitably used as a soft packaging material for food and the like. It should be noted that the soft packaging material is, in terms of configuration, a packaging material formed of a material rich in flexibility, and generally refers to a packaging material formed of a thin and flexible material such as paper, a film, or aluminum foil alone or formed of such thin and flexible materials that are attached together. The soft packaging material refers to, in terms of shape, a packaging material, such as a bag, which maintains its three-dimensional shape when the contents are put therein.

When the paper barrier base material according to the present invention is used as a packaging material, in particular, a soft packaging material, for food and the like, the paper barrier base material may be laminated with a resin having a heat sealing property. In such a case, it is possible to enhance the airtightness of the packaging material, to protect the contents from, for example, oxidation due to oxygen and deterioration due to moisture or the like, and to extend the preservation period.

When the paper barrier base material according to the present invention is used as a laminate used for an industrial material or the like, intrusion of oxygen and moisture can be suppressed to prevent decay and deterioration, and in addition, an effect such as a flavor barrier property to prevent the odor of a solvent from leaking out is also expected.

EXAMPLES

The present invention will now be specifically described with reference to Examples; however, it goes without saying that the present invention is not limited to these examples. It should be noted that, unless otherwise specified, "part" and "%" in the examples refer to "part by weight" and "% by weight", respectively. The obtained paper barrier base materials were tested in accordance with the evaluation methods described below.

(Evaluation Method)

<B-Type Viscosity>

The viscosity of each of the obtained water vapor barrier layer coating liquids at a temperature of 25° C. was measured with a Brookfield viscometer (BII viscometer, manufactured by Tokyo Keiki Inc.) using a No. 3 rotor at a rotation speed of 60 rpm.

<Static Surface Tension>

The static surface tension of each of the obtained water vapor barrier layer coating liquids at a temperature of 25° C. was measured with a fully automatic surface tensiometer (CBVP-Z, manufactured by Kyowa Interface Science Co., Ltd.).

<Spinnability>

The spinnability of each of the obtained water vapor barrier layer coating liquids at a temperature of 25° C. was measured with an extensional viscometer (CaBER 1, manufactured by Thermo Haake Inc.).

<Coating Unevenness>

A paper barrier base material having a coating width of 2,100 mm is divided into three portions each having a width of 700 mm in the width direction. The portions are referred to as a front (operation side of curtain coater), a center (central portion), and a back (driving side of curtain coater).

Ten A4-size (210 mm in width×297 mm in height) measurement samples were cut out along a center line which is a central portion (portion having a width of 350 mm) of each of the front, center, and back. The water vapor permeability (water vapor barrier property) and the oxygen permeability (gas barrier property) of a total of 30 measurement samples were measured under the following conditions.

For each of the water vapor permeability (water vapor barrier property) and the oxygen permeability (gas barrier property), coating unevenness (variation in barrier property) was evaluated from the difference between the maximum value and the average value.

1) Water Vapor Permeability (Water Vapor Barrier Property)

The water vapor permeability was measured by using a moisture permeability measuring device (L80-4000, manufactured by Dr. Lyssy) in accordance with JIS K7129A: 2008 at a temperature of 40±0.5° C. and a relative humidity difference of 90±2%.

2) Oxygen Permeability (Gas Barrier Property)

The oxygen permeability was measured under the condition of 23° C.-0% RH by using OX-TRAN2/21 manufactured by MOCON Inc.

Example 1

(Production of Paper Base Material)

Hardwood bleached kraft pulp (LBKP) having a Canadian standard freeness (CSF) of 500 ml and softwood bleached kraft pulp (NBKP) having a CSF of 530 ml were blended at a weight ratio of 80/20 to obtain material pulp.

To the material pulp, polyacrylamide (PAM) having a molecular weight of 2,500,000 was added as a dry paper strengthening agent in an amount of 0.1% per absolute dry pulp weight, an alkyl ketene dimer (AKD) was added as a sizing agent in an amount of 0.35% per absolute dry pulp weight, a polyamide epichlorohydrin (PAEH) resin was added as a wet paper strengthening agent in an amount of 0.15% per absolute dry pulp weight, and polyacrylamide (PAM) having a molecular weight of 10,000,000 was added as a retention aid in an amount of 0.08% per absolute dry pulp weight. Subsequently, the resulting mixture was put through a Fourdrinier papermaking machine to obtain paper with a grammage of 59 g/m$^2$.

Next, an aqueous solution of polyvinyl alcohol (product name: PVA117, manufactured by Kuraray Co., Ltd.) that had been prepared to have a solid content concentration of 2% was applied to thus-obtained paper by using a rod-metering size press such that the total of the aqueous solution of polyvinyl alcohol applied onto both surfaces was 1.0 g/m$^2$ and then dried to obtain base paper with a grammage of 60 g/m$^2$. The obtained base paper was smoothed by a single pass on a chilled calender at a speed of 300 min/m and a line pressure of 50 kgf/cm.

(Preparation of Water Vapor Barrier Layer Coating Liquid A1)

To engineered kaolin (product name: Barrisurf HX, average particle size: 9.0 μm, aspect ratio: 80 to 100, manufactured by Imerys), polyacrylate soda was added (0.2% relative to the pigment) as a dispersant. The mixture was then dispersed in a Serie mixer to prepare a kaolin slurry having a solid content concentration of 60%. To 80 parts (solid content) of the kaolin slurry prepared above, 20 parts (solid content) of talc (product name: TALCRON, manufactured by Specialty MINERALS Inc.) was added to prepare a pigment slurry A1 having a solid content concentration of 50%.

Into the pigment slurry A1 prepared above, 50 parts (solid content) of a styrene-acrylic copolymer emulsion (product name: X-511-374E, manufactured by Saiden Chemical Industry Co., Ltd.) and 50 parts (solid content) of an acrylic resin (product name: BARIASTAR ASN 1004, manufactured by Mitsui Chemicals, Inc.) relative to 100 parts (solid content) of the pigment were blended as water vapor barrier resins. Furthermore, a paraffin water repellent (product name: MYE-35G, wax-containing polyethylene emulsion, manufactured by Maruyoshi Chemical Co., Ltd.), a silicone surface-active agent (product name: SN-WET 125, manufactured by SAN NOPCO Limited), and a viscosity modifier (sodium polyacrylate, product name: ARONVIS MX, manufactured by TOAGOSEI Co., Ltd.) were blended such that the amounts of the paraffin water repellent, silicone surface-active agent, and viscosity modifier were 70 parts (solid content), 1.5 parts (solid content), and 0.05 parts (solid content), respectively, relative to 100 parts of the pigment. Thus, a water vapor barrier layer coating liquid A1 having a solid content concentration of 35% was obtained.

The water vapor barrier layer coating liquid A1 had a B-type viscosity of 180 mPa·s at a temperature of 25° C., and a static surface tension of 32.8 mN/m and a spinnability of 0.08 seconds at a temperature of 25° C.

(Preparation of Gas Barrier Layer Coating Liquid B1)

To engineered kaolin (product name: Barrisurf HX, average particle size: 9.0 μm, aspect ratio: 80 to 100, manufactured by Imerys), polyacrylate soda was added (0.2% relative to the pigment) as a dispersant. The mixture was then dispersed in a Serie mixer to prepare a kaolin slurry having a solid content concentration of 60%. To 86 parts (solid content) of the kaolin slurry prepared above, 14 parts (solid content) of talc (product name: TALCRON, manufactured by Specialty MINERALS Inc.) was added to prepare a pigment slurry B having a solid content concentration of 50%.

Into the pigment slurry B prepared above, an aqueous solution of polyvinyl alcohol (product name: PVA117, solid content concentration: 15%, manufactured by Kuraray Co., Ltd.) was blended such that the amount of the aqueous solution of polyvinyl alcohol was 70 parts (solid content) relative to 100 parts (solid content) of the pigment. Thus, a gas barrier layer coating liquid B1 having a solid content concentration of 23% was obtained.

The gas barrier layer coating liquid B1 had a B-type viscosity of 250 mPa·s at a temperature of 25° C., and a static surface tension of 28.0 mN/m and a spinnability of 0.20 seconds at a temperature of 25° C.

(Production of Paper Barrier Base Material)

The water vapor barrier layer coating liquid A1 (solid content concentration: 35%, temperature: 25° C.) was applied to one surface of the obtained base paper with a curtain coater at a coating speed of 300 m/min such that the coating quantity was 10 g/m$^2$ on a dry weight basis, and the gas barrier layer coating liquid B1 (solid content concentration: 23%, temperature: 25° C.) was applied to the water vapor barrier layer coating liquid A1, without a drying step interposed therebetween, with a curtain coater at a coating speed of 300 m/min such that the coating quantity was 5.0 g/m$^2$ on a dry weight basis. Drying was then performed to obtain a paper barrier base material.

Example 2

(Preparation of Water Vapor Barrier Layer Coating Liquid A2)

To engineered kaolin (product name: Barrisurf HX, average particle size: 9.0 μm, aspect ratio: 80 to 100, manufactured by Imerys), polyacrylate soda was added (0.2% relative to the pigment) as a dispersant. The mixture was then dispersed in a Serie mixer to prepare a kaolin slurry having a solid content concentration of 60%. To 75 parts (solid content) of the kaolin slurry prepared above, 25 parts (solid content) of talc (product name: TALCRON, manufactured by Specialty MINERALS Inc.) was added to prepare a pigment slurry A2 having a solid content concentration of 50%.

Into the pigment slurry A2 prepared above, 50 parts (solid content) of a styrene-acrylic copolymer emulsion (product name: X-511-374E, manufactured by Saiden Chemical Industry Co., Ltd.) and 50 parts (solid content) of an acrylic resin (product name: BARIASTAR ASN 1004, manufactured by Mitsui Chemicals, Inc.) relative to 100 parts (solid content) of the pigment were blended as water vapor barrier resins. Furthermore, a paraffin water repellent (product name: MYE-35G, wax-containing polyethylene emulsion, manufactured by Maruyoshi Chemical Co., Ltd.), a silicone surface-active agent (product name: SN-WET 125, manufactured by SAN NOPCO Limited), and a viscosity modifier (polyacrylamide-based copolymer, product name: VIS-TOOL 300, manufactured by SAN NOPCO Limited) were blended such that the amounts of the paraffin water repellent, silicone surface-active agent, and viscosity modifier were 70 parts (solid content), 1.5 parts (solid content), and 0.5 parts (solid content), respectively, relative to 100 parts of the pigment. Thus, a water vapor barrier layer coating liquid A2 having a solid content concentration of 33% was obtained.

The water vapor barrier layer coating liquid A2 had a B-type viscosity of 180 mPa·s at a temperature of 25° C., and a static surface tension of 35.0 mN/m and a spinnability of 0.17 seconds at a temperature of 25° C.

A paper barrier base material was obtained as in Example 1 except that the water vapor barrier layer coating liquid A2 was used instead of the water vapor barrier layer coating liquid A1.

Comparative Example 1

(Preparation of Gas Barrier Layer Coating Liquid B2)

The gas barrier layer coating liquid B1 having a solid content concentration of 23% was diluted so as to have a solid content concentration of 21% to obtain a gas barrier layer coating liquid B2.

The gas barrier layer coating liquid B2 had a B-type viscosity of 150 mPa·s at a temperature of 25° C., and a static surface tension of 29.0 mN/m and a spinnability of 0.15 seconds at a temperature of 25° C.

A paper barrier base material was obtained as in Example 1 except that the gas barrier layer coating liquid B2 was used instead of the gas barrier layer coating liquid B1.

Example 3

(Preparation of Gas Barrier Layer Coating Liquid B3)

The gas barrier layer coating liquid B1 having a solid content concentration of 23% was diluted so as to have a solid content concentration of 22.5% to obtain a gas barrier layer coating liquid B3.

The gas barrier layer coating liquid B3 had a B-type viscosity of 230 mPa·s at a temperature of 25° C., and a static surface tension of 28.5 mN/m and a spinnability of 0.18 seconds at a temperature of 25° C.

A paper barrier base material was obtained as in Example 1 except that the gas barrier layer coating liquid B3 was used instead of the gas barrier layer coating liquid B1.

Example 4

(Preparation of Gas Barrier Layer Coating Liquid B4)

Into the pigment slurry B obtained in the preparation of the gas barrier layer coating liquid B1, an aqueous solution of polyvinyl alcohol (product name: PVA117, solid content concentration: 15%, manufactured by Kuraray Co., Ltd.) was blended such that the amount of the aqueous solution of polyvinyl alcohol was 120 parts (solid content) relative to 100 parts (solid content) of the pigment. Thus, a gas barrier layer coating liquid B4 having a solid content concentration of 21% was obtained.

The gas barrier layer coating liquid B4 had a B-type viscosity of 380 mPa·s at a temperature of 25° C., and a static surface tension of 31.0 mN/m and a spinnability of 0.22 seconds at a temperature of 25° C.

A paper barrier base material was obtained as in Example 1 except that the gas barrier layer coating liquid B4 was used instead of the gas barrier layer coating liquid B1.

Example 5

(Preparation of Gas Barrier Layer Coating Liquid B5)

Into the pigment slurry B obtained in the preparation of the gas barrier layer coating liquid B1, an aqueous solution of polyvinyl alcohol (product name: PVA117, solid content concentration: 15%, manufactured by Kuraray Co., Ltd.) was blended such that the amount of the aqueous solution of polyvinyl alcohol was 150 parts (solid content) relative to 100 parts (solid content) of the pigment. Thus, a gas barrier layer coating liquid B5 having a solid content concentration of 20% was obtained.

The gas barrier layer coating liquid B5 had a B-type viscosity of 430 mPa·s at a temperature of 25° C., and a static surface tension of 33.0 mN/m and a spinnability of 0.25 seconds at a temperature of 25° C.

A paper barrier base material was obtained as in Example 1 except that the gas barrier layer coating liquid B5 was used instead of the gas barrier layer coating liquid B1.

TABLE 1

| | | | Example 1 | Example 2 | Example 3 | Example 4 | Example 5 | Comparative Example 1 |
|---|---|---|---|---|---|---|---|---|
| Water vapor barrier layer coating liquid | | | A1 | A2 | A1 | A1 | A1 | A1 |
| B-type viscosity | | mPa · s | 180 | 180 | 180 | 180 | 180 | 180 |
| Static surface tension | | mN/m | 32.8 | 35.0 | 32.8 | 32.8 | 32.8 | 32.8 |
| Solid content concentration | | % | 35 | 33 | 35 | 35 | 35 | 35 |
| Spinnability | | sec | 0.08 | 0.17 | 0.08 | 0.08 | 0.08 | 0.08 |
| Gas barrier layer coating liquid | | | B1 | B1 | B3 | B4 | B5 | B2 |
| B-type viscosity | | mPa · s | 250 | 250 | 230 | 380 | 430 | 150 |
| Static surface tension | | mN/m | 28.0 | 28.0 | 28.5 | 31.0 | 33.0 | 29.0 |
| Solid content concentration | | % | 23 | 23 | 22.5 | 21 | 20 | 21 |
| Spinnability | | sec | 0.20 | 0.20 | 0.18 | 0.22 | 0.25 | 0.15 |
| Water vapor permeability | Maximum value | $g/m^2 \cdot day$ | 3.6 | 4.2 | 3.8 | 3.2 | 2.8 | 10.0 |
| | Average value | | 2.9 | 3.5 | 3.1 | 2.5 | 2.2 | 5.0 |
| Oxygen permeability | Maximum value | $ml/m^2 \cdot day$ | 0.9 | 2.0 | 3.1 | 0.6 | 0.4 | 8.6 |
| | Average value | | 0.7 | 1.8 | 2.9 | 0.5 | 0.2 | 4.1 |

In Example 1, the occurrence of coating unevenness in wet-on-wet coating by the curtain coating method was suppressed. With regard to both the water vapor barrier property and the gas barrier property of the obtained paper barrier base material, the difference between the maximum value and the average value was small, and the average value was also good. In Example 2, although both the water vapor barrier property and the gas barrier property were slightly inferior to those in Example 1, the difference between the maximum value and the average value was small, and the paper barrier base material obtained in Example 2 was sufficient for practical use. In Examples 3 to 5, with regard to both the water vapor barrier property and the gas barrier property of the obtained paper barrier base material, the difference between the maximum value and the average value was small, and the average value was also good. In Examples 1 and 3 to 5, the same water vapor barrier layer coating liquid A1 was applied. As the viscosity of the gas barrier layer coating liquid was increased, the water vapor barrier property was improved. This is probably because, as the viscosity of the gas barrier layer coating liquid was increased, the disorder of the water vapor barrier coating film in an undried state decreased, and a more uniform water vapor barrier layer was formed.

In Comparative Example 1, coating unevenness was large. With regard to both the water vapor barrier property and the gas barrier property of the obtained paper barrier base material, the difference between the maximum value and the average value was large, and the average value was also poor. The paper barrier base material obtained in Comparative Example 1 was not sufficient for practical use.

The invention claimed is:

1. A method for manufacturing a paper barrier base material, comprising:

a step of applying a water vapor barrier layer coating liquid that contains at least a water vapor barrier resin and a pigment onto a paper base material by a curtain coating method to form a water vapor barrier layer, wherein the pigment has an aspect ratio of 10 or more and a 50% volume-average particle size, D50, of 5 μm or more; and a step of applying a gas barrier layer coating liquid that contains at least one polymer selected from water-soluble polymers and water-dispersible polymers onto the water vapor barrier layer by a curtain coating method without a drying step interposed between the two steps to form a gas barrier layer, wherein a B-type viscosity of the gas barrier layer coating liquid is 10 to 220 mPa·s higher than a B-type viscosity of the water vapor barrier layer coating liquid, wherein the B-type viscosity is a viscosity in mPa·s measured with a B-type viscometer at a temperature of 25° C. at a rotation speed of 60 rpm.

2. The method for manufacturing a paper barrier base material according to claim 1, wherein the gas barrier layer coating liquid has a static surface tension equal to or lower than a static surface tension of the water vapor barrier layer coating liquid.

3. The method for manufacturing a paper barrier base material according to claim 2, wherein the water vapor barrier layer coating liquid has a B-type viscosity of 100 mPa·s or more and 400 mPa·s or less at a temperature of 25° C., and the gas barrier layer coating liquid has a B-type viscosity of 150 mPa·s or more and 500 mPa·s or less at a temperature of 25° C.

4. The method for manufacturing a paper barrier base material according to claim 3, wherein the water vapor barrier layer coating liquid has a static surface tension of 30 mN/m or more and 40 mN/m or less at a temperature of 25° C., and the gas barrier layer coating liquid has a static surface tension of 25 mN/m or more and 35 mN/m or less at a temperature of 25° C.

5. The method for manufacturing a paper barrier base material according to claim 4, wherein the water vapor barrier layer coating liquid has a solid content concentration of 25% by weight or more and 45% by weight or less, and the gas barrier layer coating liquid has a solid content concentration of 15% by weight or more and 35% by weight or less.

6. The method for manufacturing a paper barrier base material according to claim 3, wherein the water vapor barrier layer coating liquid has a solid content concentration of 25% by weight or more and 45% by weight or less, and the gas barrier layer coating liquid has a solid content concentration of 15% by weight or more and 35% by weight or less.

7. The method for manufacturing a paper barrier base material according to claim 2, wherein the water vapor barrier layer coating liquid has a static surface tension of 30 mN/m or more and 40 mN/m or less at a temperature of 25° C., and the gas barrier layer coating liquid has a static surface tension of 25 mN/m or more and 35 mN/m or less at a temperature of 25° C.

8. The method for manufacturing a paper barrier base material according to claim 7, wherein the water vapor barrier layer coating liquid has a solid content concentration of 25% by weight or more and 45% by weight or less, and the gas barrier layer coating liquid has a solid content concentration of 15% by weight or more and 35% by weight or less.

9. The method for manufacturing a paper barrier base material according to claim 2, wherein the water vapor barrier layer coating liquid has a solid content concentration of 25% by weight or more and 45% by weight or less, and the gas barrier layer coating liquid has a solid content concentration of 15% by weight or more and 35% by weight or less.

10. The method for manufacturing a paper barrier base material according to claim 1, wherein the water vapor barrier layer coating liquid has a B-type viscosity of 100 mPa·s or more and 400 mPa·s or less at a temperature of 25° C., and the gas barrier layer coating liquid has a B-type viscosity of 150 mPa·s or more and 500 mPa·s or less at a temperature of 25° C.

11. The method for manufacturing a paper barrier base material according to claim 10, wherein the water vapor barrier layer coating liquid has a static surface tension of 30 mN/m or more and 40 mN/m or less at a temperature of 25° C., and the gas barrier layer coating liquid has a static surface tension of 25 mN/m or more and 35 mN/m or less at a temperature of 25° C.

12. The method for manufacturing a paper barrier base material according to claim 11, wherein the water vapor barrier layer coating liquid has a solid content concentration of 25% by weight or more and 45% by weight or less, and the gas barrier layer coating liquid has a solid content concentration of 15% by weight or more and 35% by weight or less.

13. The method for manufacturing a paper barrier base material according to claim 10, wherein the water vapor barrier layer coating liquid has a solid content concentration of 25% by weight or more and 45% by weight or less, and the gas barrier layer coating liquid has a solid content concentration of 15% by weight or more and 35% by weight or less.

14. The method for manufacturing a paper barrier base material according to claim 1, wherein the water vapor barrier layer coating liquid has a static surface tension of 30 mN/m or more and 40 mN/m or less at a temperature of 25° C., and the gas barrier layer coating liquid has a static surface tension of 25 mN/m or more and 35 mN/m or less at a temperature of 25° C.

15. The method for manufacturing a paper barrier base material according to claim 14, wherein the water vapor barrier layer coating liquid has a solid content concentration of 25% by weight or more and 45% by weight or less, and the gas barrier layer coating liquid has a solid content concentration of 15% by weight or more and 35% by weight or less.

16. The method for manufacturing a paper barrier base material according to claim 1, wherein the water vapor barrier layer coating liquid has a solid content concentration of 25% by weight or more and 45% by weight or less, and the gas barrier layer coating liquid has a solid content concentration of 15% by weight or more and 35% by weight or less.

* * * * *